US005865714A

United States Patent [19]

Marlowe

[11] Patent Number: 5,865,714

[45] Date of Patent: Feb. 2, 1999

[54] ARM EXERCISE DEVICE

[76] Inventor: Dennis Marlowe, 1805 Hamilton St, New Castle, Pa. 16101

[21] Appl. No.: 888,258

[22] Filed: Jul. 3, 1997

[51] Int. Cl.[6] ..... A61H 1/02

[52] U.S. Cl. ..... 482/112; 482/118; 602/20; 601/33

[58] Field of Search ..... 473/214, 276; 602/16, 20, 23, 26; 482/124, 127, 111, 112, 118

[56] References Cited

U.S. PATENT DOCUMENTS

| | | | |
|---|---|---|---|
| 3,419,276 | 12/1968 | Poggioli | 473/214 |
| 3,814,419 | 6/1974 | Bjorklund et al. | 482/127 |
| 3,976,057 | 8/1976 | Barclay | 601/33 |
| 4,682,776 | 7/1987 | Mitchell | 482/127 |
| 4,801,138 | 1/1989 | Airy et al. | 482/112 |
| 5,042,799 | 8/1991 | Stanley | 482/112 |
| 5,100,126 | 3/1992 | Liou | 482/127 |
| 5,116,294 | 5/1992 | Findlay | 482/127 |
| 5,213,094 | 5/1993 | Bonutti | 601/33 |
| 5,337,737 | 8/1994 | Rubin et al. | 482/111 |
| 5,662,595 | 9/1997 | Chesher et al. | 482/124 |

*Primary Examiner*—Jerome Donnelly

[57] ABSTRACT

A new Arm Exercise Device for exercising and strengthening the triceps muscle of a user's arm. The inventive device includes an upper arm support securable to the upper arm of the user, a forearm support pivotally connected to the upper arm support and securable to the forearm of the user, and an adjustable resistance mechanism interconnecting the upper arm support and the forearm support for creating resistance in response to pivotal movement of the forearm support relative to the upper arm support.

16 Claims, 3 Drawing Sheets

ARM EXERCISE DEVICE

BACKGROUND OF THE INVENTION

1. Field of the Invention

The present invention relates to exercise devices and more particularly pertains to a new Arm Exercise Device for exercising and strengthening the triceps muscle of a user's arm.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U.S. Pat. No. 5,337,737; U.S. Pat. No. 5,042,799; U.S. Pat. No. D353,005; U.S. Pat. No. 5,437,619; U.S. Pat. No. 3,976,057; and U.S. Pat. No. D269,379.

While these devices fulfill their respective, particular objectives and requirements, the aforementioned patents do not disclose a new Arm Exercise Device. The inventive device includes an upper arm support securable to the upper arm of the user, a forearm support pivotally connected to the upper arm support and securable to the forearm of the user, and an adjustable resistance means interconnecting the upper arm support and the forearm support for creating resistance in response to pivotal movement of the forearm support relative to the upper arm support.

In these respects, the Arm Exercise Device according to the present invention substantially departs from the conventional concepts and designs of the prior art, and in so doing provides an apparatus primarily developed for the purpose of exercising and strengthening the triceps muscle of a user's arm.

SUMMARY OF THE INVENTION

In view of the foregoing disadvantages inherent in the known types of exercise devices now present in the prior art, the present invention provides a new Arm Exercise Device construction wherein the same can be utilized for exercising and strengthening the triceps muscle of a user's arm.

The general purpose of the present invention, which will be described subsequently in greater detail, is to provide a new Arm Exercise Device apparatus and method which has many of the advantages of the exercise devices mentioned heretofore and many novel features that result in a new Arm Exercise Device which is not anticipated, rendered obvious, suggested, or even implied by any of the prior art exercise devices, either alone or in any combination thereof.

To attain this, the present invention generally comprises an upper arm support securable to the upper arm of the user, a forearm support pivotally connected to the upper arm support and securable to the forearm of the user, and an adjustable resistance means interconnecting the upper arm support and the forearm support for creating resistance in response to pivotal movement of the forearm support relative to the upper arm support.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Arm Exercise Device apparatus and method which has many of the advantages of the exercise devices mentioned heretofore and many novel features that result in a new Arm Exercise Device which is not anticipated, rendered obvious, suggested, or even implied by any of the prior art exercise devices, either alone or in any combination thereof.

It is another object of the present invention to provide a new Arm Exercise Device which may be easily and efficiently manufactured and marketed.

It is a further object of the present invention to provide a new Arm Exercise Device which is of a durable and reliable construction.

An even further object of the present invention is to provide a new Arm Exercise Device which is susceptible of a low cost of manufacture with regard to both materials and labor, and which accordingly is then susceptible of low prices of sale to the consuming public, thereby making such Arm Exercise Device economically available to the buying public.

Still yet another object of the present invention is to provide a new Arm Exercise Device which provides in the apparatuses and methods of the prior art some of the advantages thereof, while simultaneously overcoming some of the disadvantages normally associated therewith.

Still another object of the present invention is to provide a new Arm Exercise Device for exercising and strengthening the triceps muscle of a user's arm.

Yet another object of the present invention is to provide a new Arm Exercise Device which includes an upper arm support securable to the upper arm of the user, a forearm support pivotally connected to the upper arm support and securable to the forearm of the user, and an adjustable resistance means interconnecting the upper arm support and the forearm support for creating resistance in response to pivotal movement of the forearm support relative to the upper arm support.

Still yet another object of the present invention is to provide a new Arm Exercise Device that would stabilize the user's arm and isolate the specific muscle to be exercised.

Even still another object of the present invention is to provide a new Arm Exercise Device that could be used to tone and strengthen as well as rehabilitate the triceps muscle and the elbow.

Even still another object of the present invention is to provide a new Arm Exercise Device that could be used by individuals of various strength capabilities.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
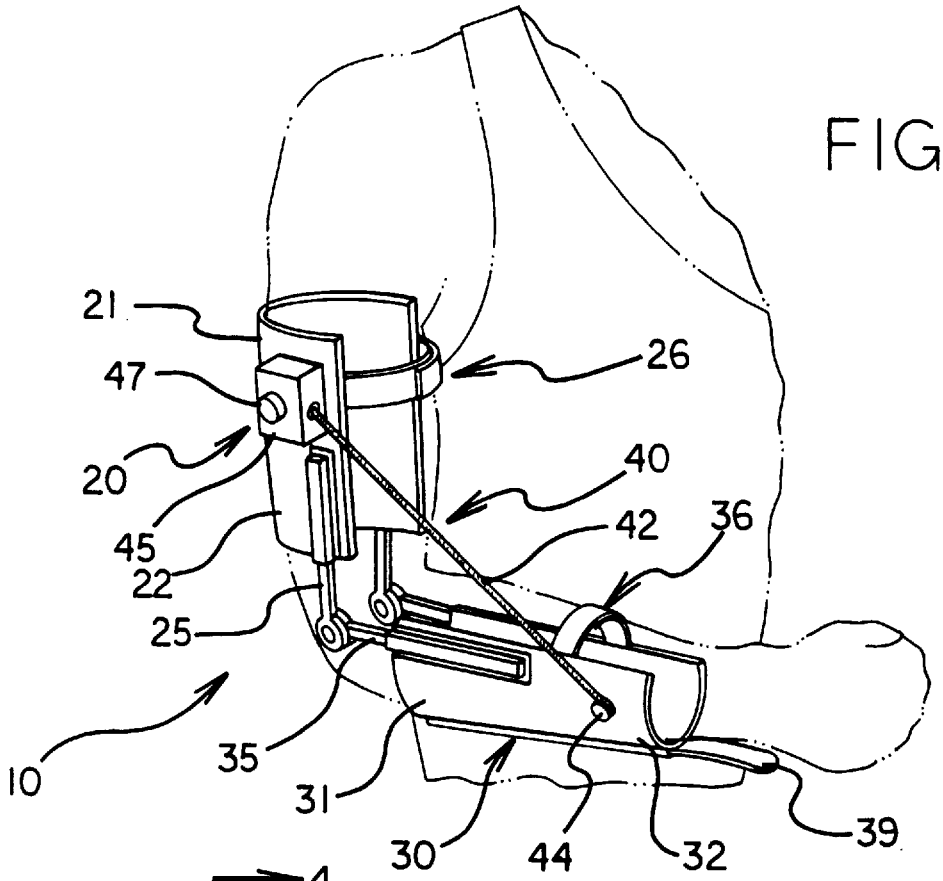
FIG. 1 is an illustration of a new Arm Exercise Device in use according to the present invention.
Figure 2:
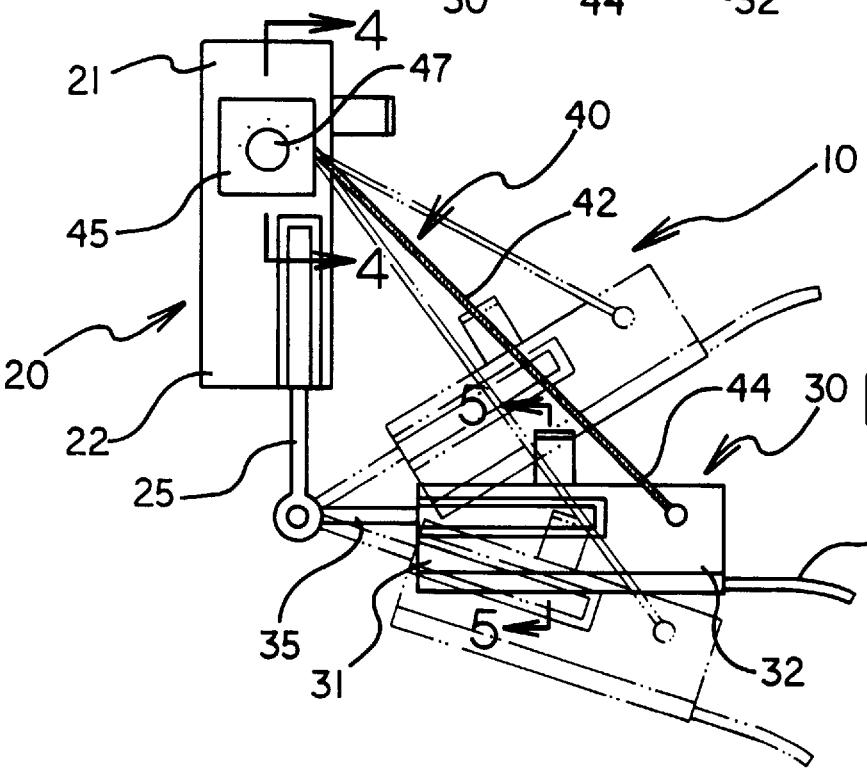
FIG. 2 is a side view of the present invention illustrating the pivotal motion thereof.
Figure 3:
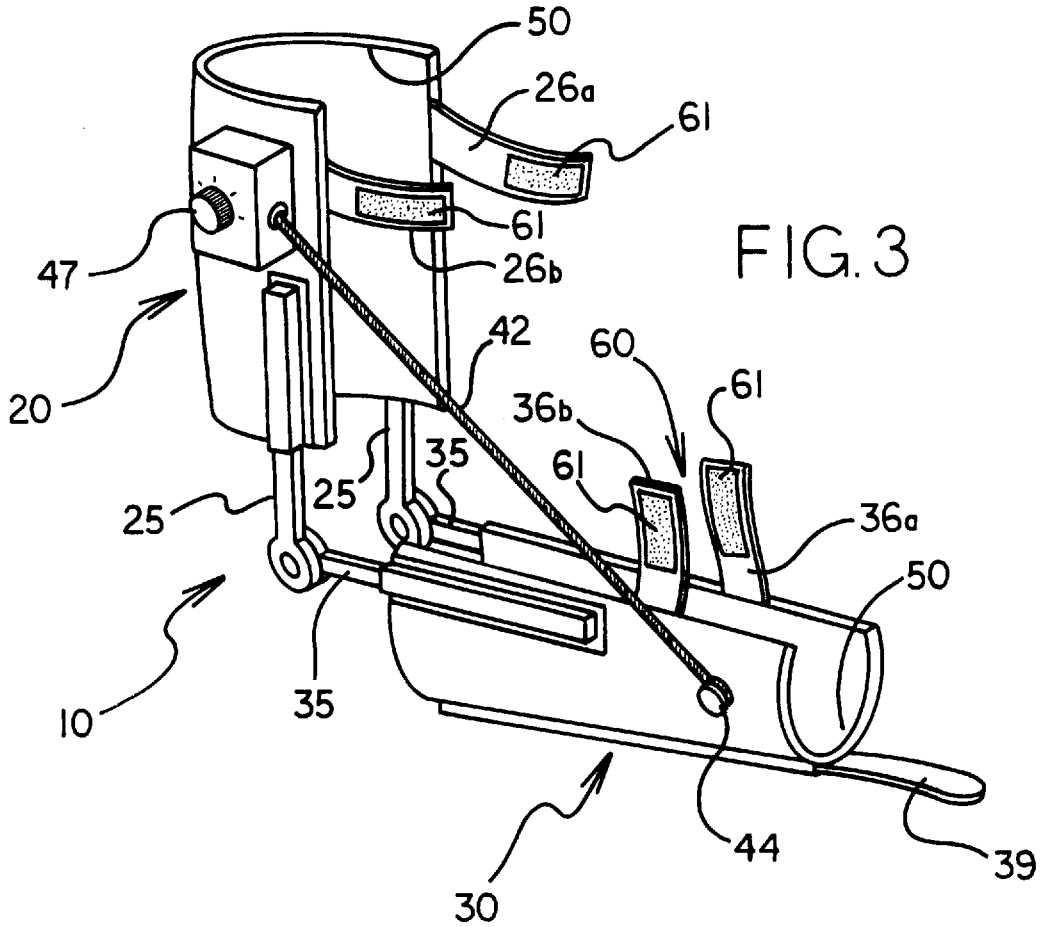
FIG. 3 is a perspective view of the present invention.
Figure 4:
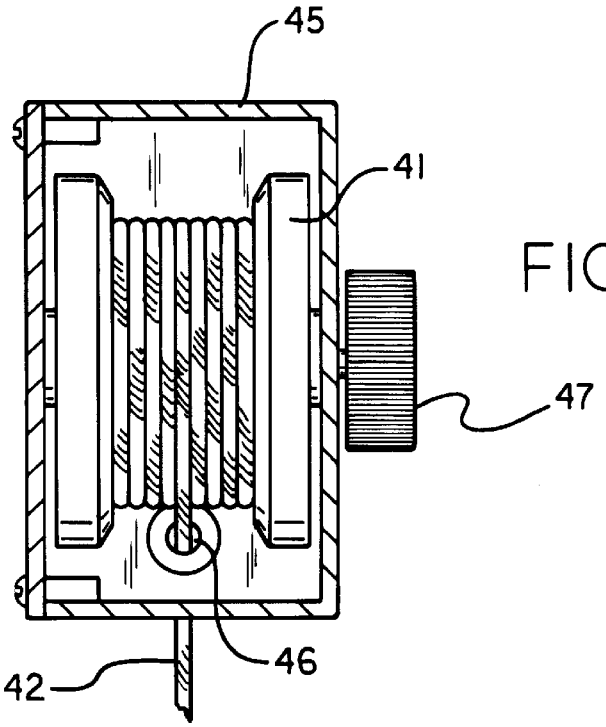
FIG. 4 is an illustration of the adjustable tensioning spool and the retractable tension cable of the present invention.
Figure 5:
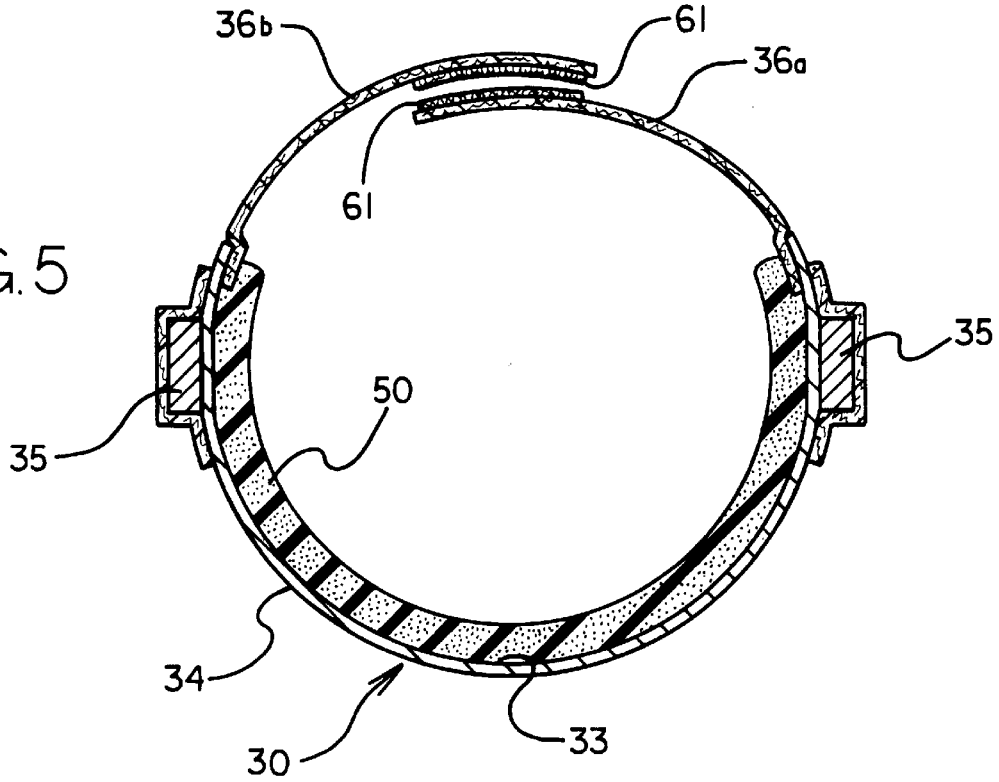
FIG. 5 is a cross sectional view taken along line 5—5 of FIG. 2.

With reference now to the drawings, and in particular to FIGS. 1 through 5 thereof, a new Arm Exercise Device embodying the principles and concepts of the present invention and generally designated by the reference numeral 10 will be described.

As best illustrated in FIGS. 1 through 5, the Arm Exercise Device 10 comprises an upper arm support 20 securable to the upper arm of the user, a forearm support 30 pivotally connected to the upper arm support 20 and securable to the forearm of the user, and an adjustable resistance means 40 interconnecting the upper arm support 20 and the forearm support 30 for creating resistance in response to pivotal movement of the forearm support 30 relative to the upper arm support 20.

The upper arm support 20 and the forearm support 30 are each substantially rigid and generally semi-cylindrical in shape. Accordingly, the upper arm support 20 is configured for partially surrounding the upper arm of the user and the forearm support 30 is configured for partially surrounding the forearm of the user. More specifically, the upper arm support 20 is adapted for generally supporting the posterior portion of the upper arm of the user and the forearm support 30 is adapted for generally supporting the posterior portion of the forearm of the user. As such, the elbow of the user remains exposed.

The upper arm support 20 and the forearm support 30 each have a first end 21 and 31, respectively, and a second end 22 and 32, respectively. In addition, the upper arm support 20 and the forearm support 30 each have an inner surface 23 and 33, respectively, and an outer surface 24 and 34, respectively. In a preferred embodiment, a hand rest 39 extends from the second end 32 of the forearm support 30. During use of the Arm Exercise Device 10, the hand rest 39 provides support for the wrist and the hand of the user. Furthermore, the upper arm support 20 and the forearm support 30 each include a padding material 50 disposed on the inner surfaces 23 and 33, respectively, thereof.

The upper arm support 20 includes an upper arm brace 25 extending from the second end 22 thereof and the forearm support 30 includes a forearm brace 35 extending from the first end 31 thereof. Accordingly, the upper arm brace 25 and the forearm brace 35 are pivotally connected so as to permit pivotal movement of the forearm support 30 relative to the upper arm support 20. The upper arm brace 25 and the forearm brace 35 are pivotally connected about an axis corresponding to a pivotal axis of the elbow of the user. Preferably, an upper arm brace 25 extends from the second end 22 of the upper arm support 20 along both sides thereof and a forearm brace 35 extends from the first end 31 of the forearm support 30 along both sides thereof. As such, the forearm support 30 and the upper arm support 20 are pivotally connected so as to stabilize the user's arm and isolate the specific muscle to be exercised.

To secure the Arm Exercise Device 10 to the arm of the user, the upper arm support 20 includes an upper arm strap 26 and the forearm support 30 includes a forearm strap 36. Accordingly, the upper arm strap 26 is adapted for securing the upper arm support 20 to the upper arm of the user and the forearm strap 36 is adapted for securing the forearm support 30 to the forearm of the user. The upper arm strap 26 and the forearm strap 36 each have a first end 26*a* and 36*a*, respectively, and a second end 26*b* and 36*b*, respectively, each freely extending from opposite sides of the upper arm support 20 and the forearm support 30, respectively. Accordingly, the first end 26*a* and the second end 26*b* of the upper arm strap 26 are joined together over the anterior portion of the upper arm of the user and the first end 36*a* and the second end 36*b* of the forearm strap 36 are joined together over the anterior portion of the forearm of the user.

A releasable fastener 60 is provided for releasably fastening the first end 26*a* and 36*a*, respectively, of each the upper arm strap 26 and the forearm strap 36, respectively, to the corresponding second end 26*b* and 36*b*, respectively, thereof. In a preferred embodiment, the releasable fastener 60 comprises a hook and loop fastener 61 including a hook portion provided at the first end 26*a* and 36*a*, respectively, of each the upper arm strap 26 and the forearm strap 36, respectively, and a loop portion provided at the second end 26*b* and 36*b*, respectively, of each the upper arm strap 26 and the forearm strap 36, respectively.

In a preferred embodiment, the adjustable resistance means 40 includes an adjustable tensioning spool 41 rotatably secured to the upper arm support 20 and a retractable tension cable 42 having a first end 43 secured to the adjustable tensioning spool 41 and a second end 44 secured to the forearm support 30. Preferably, the adjustable tensioning spool 41 is mounted on the outer surface 24 of the upper arm support 20 adjacent the first end 21 thereof. In addition, the second end 44 of the retractable tension cable 42 is secured to the outer surface 34 of the forearm support 30 adjacent the second end 32 thereof. The adjustable tensioning spool 41 is generally enclosed by a housing 45. Accordingly, the housing 45 includes a hole 46 through which the retractable tension cable 42 passes.

The adjustable tensioning spool 41 imposes tension on the retractable tension cable 42 as the forearm support 30 is pivoted away from the upper arm support 20. As such, the user must overcome the imposed tension to pivot the forearm support relative 30 to the upper arm support 20. Accordingly, an adjustment knob 47 is operably connected to the adjustable tensioning spool 41 for adjusting the tension imposed on the retractable tension cable 42. The adjustable tensioning spool 41 also retracts the retractable tension cable 42 as the forearm support 30 is pivoted towards the upper arm support 20.

In use, the user secures his or her upper arm in the upper arm support 20 with the upper arm strap 26 and secures his or her forearm in the forearm support 30 with the forearm strap 36. The user then adjusts the tension of the retractable tension cable 42 to the desired level with the adjustment knob 47. Thereafter, the user alternately straightens and bends his or her arm at the elbow. While straightening their arm, the user must overcome the tension imposed on the retractable tension cable 42 as the forearm support 30 is pivoted away from the upper arm support 20. While doing so, the user exercises his or her triceps muscle. To isolate the triceps muscle desired to be exercised, the user may place his or her forearm in the forearm support 30 such that their hand is oriented palm side up, palm side down, or sideways.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An arm exercise device, comprising:

an upper arm support securable to the upper arm of a user, said upper arm support adapted for generally supporting the posterior portion of the upper arm of the user;

a forearm support pivotally connected to said upper arm support and securable to the forearm of the user, said forearm support adapted for generally supporting the posterior portion of the forearm of the user;

an adjustable resistance means interconnecting said upper arm support and said forearm support for creating resistance in response to pivotal movement of said forearm support relative to said upper arm support;

wherein said adjustable resistance means includes an adjustable tensioning spool rotatably secured to said upper arm support and a retractable tension cable having a first end secured to said adjustable tensioning spool and a second end secured to said forearm support; and said adjustable tensioning spool imposing tension on said retractable tension cable as said forearm support is pivoted away from said upper arm support and said adjustable tensioning spool retracting said retractable tension cable as said forearm support is pivoted towards said upper arm support.

2. The arm exercise device of claim 1, wherein said upper arm support and said forearm support are each generally semi-cylindrical in shape.

3. The arm exercise device of claim 1, wherein said upper arm support and said forearm support each have a first end and a second end, and wherein said upper arm support and said forearm support each have an inner surface and an outer surface.

4. The arm exercise device of claim 3, further comprising:

a hand rest extending from said second end of said forearm support, said hand rest supporting in use the wrist and the hand of the user.

5. The arm exercise device of claim 3, wherein said upper arm support and said forearm support each include a padding material disposed on said inner surfaces thereof.

6. The arm exercise device of claim 3, wherein said upper arm support includes an upper arm brace extending from said second end thereof, and wherein said forearm support includes a forearm brace extending from said first end thereof, said upper arm brace and said forearm brace pivotally connected so as to permit pivotal movement of said forearm support relative to said upper arm support, said upper arm brace and said forearm brace pivotally connected about an axis corresponding to a pivotal axis of the elbow of the user.

7. The arm exercise device of claim 1, wherein said upper arm support includes an upper arm strap, said upper arm strap adapted for securing said upper arm support to the upper arm of the user, and wherein said forearm support includes a forearm strap, said forearm strap adapted for securing said forearm support to the forearm of the user.

8. The arm exercise device of claim 1, wherein said adjustable resistance means further includes an adjustment knob operably connected to said adjustable tensioning spool for adjusting the tension imposed on said retractable tension cable.

9. An arm exercise device, comprising:

an upper arm support securable to the upper arm of a user, said upper arm support being generally semi-cylindrical in shape and having a first end and a second end and having an inner surface and an outer surface, said upper arm support configured for partially surrounding the upper arm of the user and adapted for generally supporting the posterior portion of the upper arm of the user;

a forearm support pivotally connected to said upper arm support and securable to the forearm of the user, said forearm support being generally semi-cylindrical in shape and having a first end and a second end and having an inner surface and an outer surface, said forearm support configured for partially surrounding the forearm of the user and adapted for generally supporting the posterior portion of the forearm of the user;

an adjustable resistance means interconnecting said upper arm support and said forearm support for creating resistance in response to pivotal movement of said forearm support away from said upper arm support;

wherein said adjustable resistance means includes an adjustable tensioning spool rotatable secured to said upper arm support and a retractable tension cable having a first end secured to said adjustable tensioning spool and a second end secured to said forearm support; and said adjustable tensioning spool imposing tension on said retractable tension cable as said forearm support is pivoted away from said upper arm support and said adjustable tensioning spool retracting said retractable tension cable as said forearm support is pivoted towards said upper arm support.

10. The arm exercise device of claim 9, further comprising:

a hand rest extending from said second end of said forearm support, said hand rest supporting in use the wrist and the hand of the user.

11. The arm exercise device of claim 9, wherein said upper arm support and said forearm support each include a padding material disposed on said inner surfaces thereof.

12. The arm exercise device of claim 9, wherein said upper arm support includes an upper arm brace extending from said second end thereof, and wherein said forearm support includes a forearm brace extending from said first end thereof, said upper arm brace and said forearm brace pivotally connected so as to permit pivotal movement of said forearm support relative to said upper arm support, said upper arm brace and said forearm brace pivotally connected about an axis corresponding to a pivotal axis of the elbow of the user.

13. The arm exercise device of claim 9, wherein said upper arm support includes an upper arm strap, said upper arm strap adapted for securing said upper arm support to the upper arm of the user, and wherein said forearm support includes a forearm strap, said forearm strap adapted for securing said forearm support to the forearm of the user.

14. The arm exercise device of claim 9, wherein said adjustable resistance means further includes an adjustment knob operably connected to said adjustable tensioning spool for adjusting the tension imposed on said retractable tension cable.

15. The arm exercise device of claim 9 further comprising:

a hand rest extending from said second end of said forearm support, said hand rest supporting in use the wrist and the hand of the user;

wherein said upper arm support and said forearm support each include a padding material disposed on said inner surfaces thereof;

wherein said upper arm support includes an upper arm brace extending from said second end thereof;

wherein said forearm support includes a forearm brace extending from said first end thereof, said upper arm brace and said forearm brace pivotally connected so as to permit pivotal movement of said forearm support relative to said upper arm support;

said upper arm brace and said forearm brace being pivotally connected about an axis corresponding to a pivotal axis of the elbow of the user;

wherein said upper arm support includes an upper arm strap, said upper arm strap adapted for securing said upper arm support to the upper arm of the user; and wherein said forearm support includes a forearm strap, said forearm strap adapted for securing said forearm support to the forearm of the user.

16. The arm exercise device of claim 1, further comprising:

said upper arm support and said forearm support each being generally semi-cylindrical in shape;

wherein said upper arm support and said forearm support each have a first end and a second end;

wherein said upper arm support and said forearm support each have an inner surface and an outer surface;

a hand rest extending from said second end of said forearm support, said hand rest supporting in use the wrist and the hand of the user;

wherein said upper arm support and said forearm support each include a padding material disposed on said inner surfaces thereof;

wherein said upper arm support includes an upper arm brace extending from said second end thereof;

wherein said forearm support includes a forearm brace extending from said first end thereof, said upper arm brace and said forearm brace pivotally connected so as to permit pivotal movement of said forearm support relative to said upper arm support;

said upper arm brace and said forearm brace pivotally connected about an axis corresponding to a pivotal axis of the elbow of the user;

wherein said upper arm support includes an upper arm strap, said upper arm strap adapted for securing said upper arm support to the upper arm of the user; and wherein said forearm support includes a forearm strap, said forearm strap adapted for securing said forearm support to the forearm of the user.

* * * * *